US005856076A

United States Patent [19]

Siegel et al.

[11] Patent Number: 5,856,076

[45] Date of Patent: Jan. 5, 1999

[54] COLOR PHOTOGRAPHIC RECORDING MATERIAL HAVING ELEVATED SENSITIVITY AND IMPROVED COLOR REPRODUCTION

[75] Inventors: Joerg Siegel, Leverkusen; Hans-Ulrich Borst, Elsdorf; Peter Bell, Köln; Ralf Büscher, Lohmar; Johannes Willsau, Leverkusen, all of Germany

[73] Assignee: Agfa-Gevaert Aktiengesellschaft, Germany

[21] Appl. No.: 841,073

[22] Filed: Apr. 29, 1997

[30] Foreign Application Priority Data

May 6, 1996 [DE] Germany ..... 196 18 087.2
Feb. 6, 1997 [DE] Germany ..... 197 04 372.0

[51] Int. Cl.[6] ..... G03C 1/08; G03C 7/18

[52] U.S. Cl. ..... 430/503; 430/504; 430/570; 430/585

[58] Field of Search ..... 430/585, 504, 430/570, 503

[56] References Cited

U.S. PATENT DOCUMENTS 5,437,969 8/1995 Schmuck et al. ..... 430/504

FOREIGN PATENT DOCUMENTS 409 019 7/1990 European Pat. Off. .
474 193 9/1991 European Pat. Off. .
574 927 6/1993 European Pat. Off. .

*Primary Examiner*—Thorl Chea
*Attorney, Agent, or Firm*—Connolly & Hutz

[57] ABSTRACT

A color photographic recording material having a film support and, arranged thereon, at least one red-sensitive silver halide emulsion layer containing a cyan coupler, at least one green-sensitive silver halide emulsion layer containing a magenta coupler, at least one blue-sensitive silver halide emulsion layer containing a yellow coupler and optionally further non-photosensitive layers contains, in addition to conventional sensitizing dyes, in at least one of the red-sensitive silver halide emulsion layers thereof and in at least one of the green-sensitive emulsion layers thereof at least one cyanine dye in each layer having an absorption maximum in a methanolic solution in the range from 515 to 550 nm, wherein the absorption maxima of the additional cyanine dye in the red-sensitive silver halide emulsion layer and of the additional cyanine dye in the green-sensitive layer, in each case measured in a methanolic solution, are no more than 10 nm and preferably no more than 5 nm apart. In a preferred embodiment, the additional cyanine dye in the red-sensitive silver halide emulsion layer is identical to the additional cyanine dye in the green-sensitive silver halide emulsion layer. The recording material exhibits improved sensitivity and improved color reproduction.

7 Claims, No Drawings

COLOR PHOTOGRAPHIC RECORDING MATERIAL HAVING ELEVATED SENSITIVITY AND IMPROVED COLOR REPRODUCTION

Structurally distinct dyes are conventionally used for the spectral sensitisation of each of the blue, green and red ranges of the spectrum (see for example DE-A-42 31 770, DE-A-44 23 129, DE-A-44 04 003, DE-A-44 33 637 which corresponds to U.S. Pat. No. 5,571,664, DE-A-44 34 971).

Considerable efforts have been made to improve known colour photographic recording materials with regard to their spectral sensitivity and colour reproduction. EP-A-0 409 019 describes and claims a colour photographic recording material having improved colour reproduction, which is achieved by both the green-sensitive and the red-sensitive silver halide emulsion layers receiving additional sensitisation for light from the gap between the adjacent principal green and red ranges of the spectrum by the use of one or more so-called gap sensitising dyes. In this manner, the adjacent spectral sensitivity curves are raised in the secondary spectral sensitivity range (gap) in such a manner that at most an additional 0.6 logarithmic exposure units are required in order to achieve the same colour density as in the range of the adjacent principal sensitivities.

It has now been found that not only colour reproduction but also sensitivity may be improved if one or more cyanine dyes having specific spectral absorption characteristics is/are used both for sensitisation in the green range of the spectrum and for sensitisation in the red range of the spectrum.

The present invention provides a colour photographic recording material having a film support and, arranged thereon, at least one red-sensitive silver halide emulsion layer containing a cyan coupler, at least one green-sensitive silver halide emulsion layer containing a magenta coupler, at least one blue-sensitive silver halide emulsion layer containing a yellow coupler and optionally further non-photosensitive layers, characterised in that at least one of the red-sensitive silver halide emulsion layers thereof and at least one of the green-sensitive silver halide emulsion layers thereof each contain, in addition to conventional sensitising dyes, at least one cyanine dye having an absorption spectrum in a methanolic solution in the range from 515 to 550 nm, preferably in the range from 517 to 540 nm, wherein the absorption maximum of the additional cyanine dye in the red-sensitive silver halide emulsion layer and the absorption maximum of the additional cyanine dye in the green-sensitive layer, in each case measured in a methanolic solution, are no more than 10 nm and particularly preferred no more than 5 nm apart.

The stated additional cyanine dyes are preferably carbocyanines which, on at least one of the (two) ring nitrogen atoms, bear an alkyl residue substituted by an acid group. Particularly suitable examples of these cyanine dyes belong to the class of benzimidazolecarbocyanines or to the class of oxathiacarbocyanines.

In a preferred embodiment of the invention, the additional cyanine dye in the red-sensitive silver halide emulsion layer is identical to the additional cyanine dye in the green-sensitive silver halide emulsion layer. The additional cyanine dyes are considered as identical within the context of this specification if at least the structure of the dye chromophore is identical even if any counterions which possibly may be required to neutralize the charge, are not the same.

Some examples of "additional" cyanine dyes suitable according to the invention together with the absorption maxima $\lambda_{max}$ thereof measured in methanolic solutions are shown below.

F-1

$\lambda_{max}$ ($\mu$m)

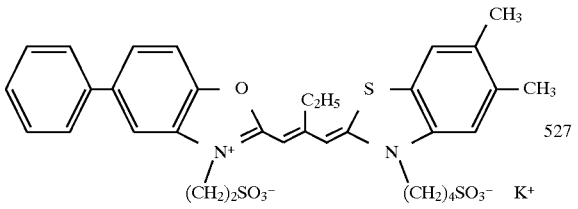

527

F-2

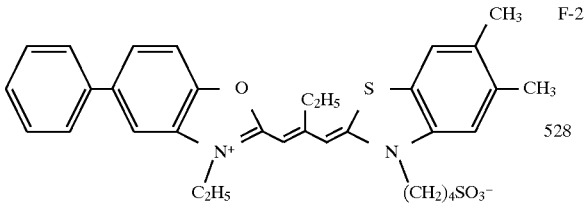

528

F-3

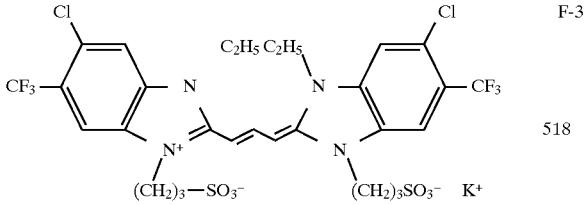

518

F-4

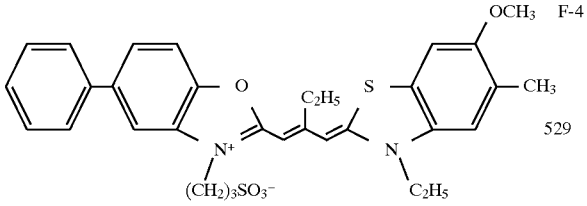

529

F-5

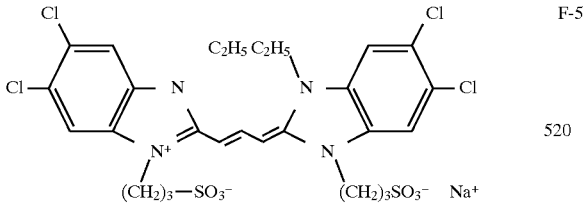

520

F-6

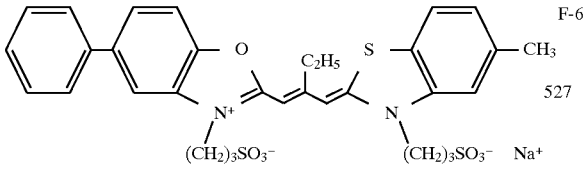

527

F-7

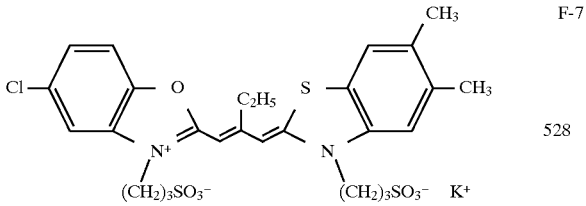

528

-continued

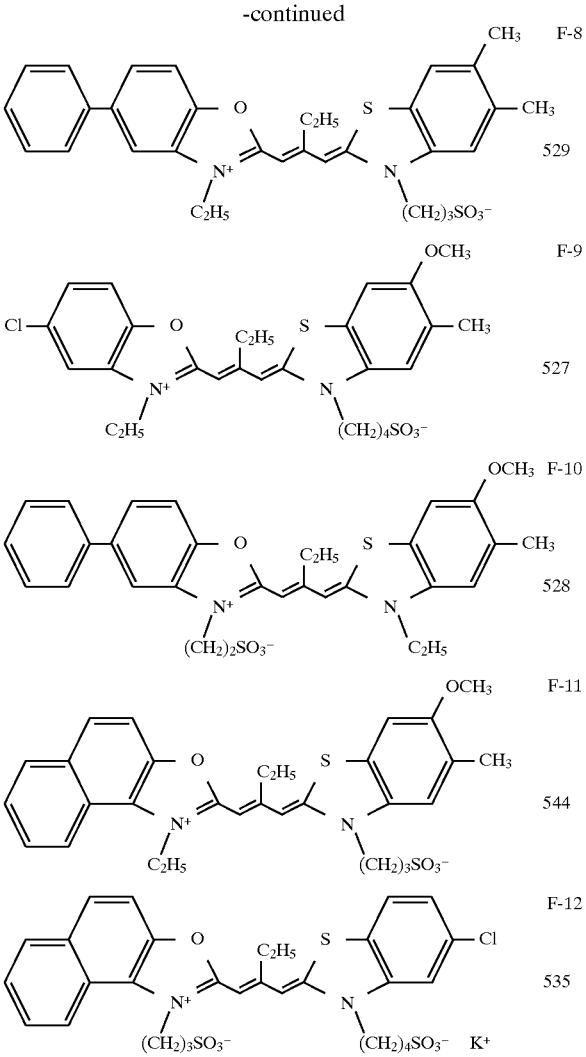

Examples of colour photographic materials are colour negative films, colour reversal films, colour positive films, colour photographic paper, colour reversal photographic paper, colour-sensitive materials for the dye diffusion transfer process or the silver dye bleaching process.

The photographic materials consist of a support onto which at least one photosensitive silver halide emulsion layer is applied. Thin films and sheets are in particular suitable as supports. A review of support materials and the auxiliary layers applied to the front and reverse sides of which is given in *Research Disclosure* 37254, part 1 (1995), page 285.

The colour photographic materials conventionally contain at least one red-sensitive, one green-sensitive and one blue-sensitive silver halide emulsion layer, optionally together with interlayers and protective layers.

Depending upon the type of the photographic material, these layers may be differently arranged. This is demonstrated for the most important products:

Colour photographic films such as colour negative films and colour reversal films have on the support, in the stated sequence, 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers. The layers of identical spectral sensitivity differ with regard to their photographic sensitivity, wherein the less sensitive partial layers are generally arranged closer to the support than the more highly sensitive partial layers.

A yellow filter layer is conventionally located between the green-sensitive and blue-sensitive layers which prevents blue light from reaching the underlying layers.

Colour photographic paper, which is usually substantially less photosensitive than a colour photographic film, conventionally has on the support, in the stated sequence, one blue-sensitive, yellow-coupling silver halide emulsion layer, one green-sensitive, magenta-coupling silver halide emulsion layer and one red-sensitive, cyan-coupling silver halide emulsion layer; the yellow filter layer may be omitted.

The number and arrangement of the photosensitive layers may be varied in order to achieve specific results. For example, all high sensitivity layers may be grouped together in one package of layers and all low sensitivity layers may be grouped together in another package of layers in order to increase sensitivity (DE 25 30 645).

Possible options for different layer arrangements and the effects thereof on photographic properties are described in *J. Int. Rec. Mats.,* 1994, volume 22, pages 183–193.

The substantial constituents of the photographic emulsion layers are binder, silver halide grains and colour couplers.

Details of suitable binders may be found in *Research Disclosure* 37254, part 2 (1995), page 286.

Details of suitable silver halide emulsions, the production, ripening, stabilisation and spectral sensitisation thereof, including suitable spectral sensitisers, may be found in *Research Disclosure* 37254, part 3 (1995), page 286 and in *Research Disclosure* 37038, part XV (1995), page 89.

Photographic materials with camera sensitivity conventionally contain silver bromide-iodide emulsions, which may optionally also contain small proportions of silver chloride. Photographic print materials contain either silver chloride-bromide emulsions with up to 80 mol. % of AgBr or silver chloride-bromide emulsions with above 95 mol. % of AgCl.

Details relating to colour couplers may be found in *Research Disclosure* 37254, part 4 (1995), page 288 and in *Research Disclosure* 37038, part II (1995), page 80. The maximum absorption of the dyes formed from the couplers and the developer oxidation product is preferably within the following ranges: yellow coupler 430 to 460 nm, magenta coupler 540 to 560 nm, cyan coupler 630 to 700 nm.

In order to improve sensitivity, grain, sharpness and colour separation in colour photographic films, compounds are frequently used which, on reaction with the developer oxidation product, release photographically active compounds, for example DIR couplers which eliminate a development inhibitor.

Details relating to such compounds, in particular couplers, may be found in *Research Disclosure* 37254, part 5 (1995), page 290 and in *Research Disclosure* 37038, part XIV (1995), page 86.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 $\mu$m in diameter) in the layers.

Suitable high-boiling organic solvents, methods for the introduction thereof into the layers of a photographic material and further methods for introducing chemical compounds into photographic layers may be found in *Research Disclosure* 37254, part 6 (1995), page 292.

The non-photosensitive interlayers generally located between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in *Research Disclosure* 37254, part 7 (1995), page 292 and in *Research Disclosure* 37038, part III (1995), page 84.

The photographic material may also contain compounds which absorb UV light, optical brighteners, spacers, filter dyes, formalin scavengers, light stabilisers, antioxidants, $D_{min}$ dyes, additives to improve the stability of dyes, couplers and whites and to reduce colour fogging, plasticisers (latices), biocides and others.

Suitable compounds may be found in *Research Disclosure* 37254, part 8 (1995), page 292 and in *Research Disclosure* 37038, parts IV, V, VI, VII, X, XI and XIII (1995), pages 84 et seq..

The layers of colour photographic materials are conventionally hardened, i.e. the binder used, preferably gelatine, is crosslinked by appropriate chemical methods.

Suitable hardener substances may be found in *Research Disclosure* 37254, part 9 (1995), page 294 and in *Research Disclosure* 37038, part XII (1995), page 86.

Once exposed with an image, colour photographic materials are processed using different processes depending upon their nature. Details relating to processing methods and the necessary chemicals are disclosed in *Research Disclosure* 37254, part 10 (1995), page 294 and in *Research Disclosure* 37038, parts XVI to XXIII (1995), pages 95 et seq. together with example materials.

EXAMPLE 1

A colour photographic recording material for colour negative development was produced (layer structure 1A—comparison) by applying the following layers in the stated sequence onto a transparent cellulose triacetate film support. All stated quantities relate to 1 $m^2$. The quantity of silver applied is stated as the corresponding quantities of $AgNO_3$. All the silver halide emulsions were stabilised with 0.1 g of 4-hydroxy-6-methyl-1,3,3a,7-tetraazaindene per 100 g of $AgNO_3$.

Layer Structure 1A

Layer 1: (Anti-halo layer)
- Black colloidal silver sol containing
  - 0.3 g of Ag
  - 1.2 g of gelatine
  - 0.4 g of UV absorber XUV-1
  - 0.02 g of tricresyl phosphate (TCP)

Layer 2: (Interlayer)
- 1.0 g of gelatine

Layer 3: (1st red-sensitive layer, low sensitivity)
- Red-sensitised silver bromide-iodide emulsion (4 mol. % iodide; average grain diameter 0.5 μm; spectrally sensitised with sensitising dyes XRS-1, XRS-2 and XRS-3 in ratio of 1:3:0.5) prepared from 2.7 g of $AgNO_3$ with
  - 2.0 g of gelatine
  - 0.88 g of cyan coupler XC-1
  - 0.05 g of coloured coupler XCR-1
  - 0.07 g of coloured coupler XCY-1
  - 0.02 g of DIR coupler XDIR-1
  - 0.75 g of TCP Layer 4: (2nd red-sensitive layer, high sensitivity)
- Red-sensitised silver bromide-iodide emulsion (12 mol. % iodide; average grain diameter 1.0 μm; spectrally sensitised with sensitising dyes XRS-1, XRS-2 and XRS-3 in ratio of 1:3.1:0.3) prepared from 2.2 g of $AgNO_3$ with
  - 1.8 g of gelatine
  - 0.19 g of cyan coupler XC-2
  - 0.17 g of TCP Layer 5: (Interlayer)
- 0.4 g of gelatine
- 0.15 g of white coupler XW-1
- 0.06 g of aurintricarboxylic acid aluminium salt Layer 6: (1st green-sensitive layer, low sensitivity)
- Green-sensitised silver bromide-iodide emulsion (4 mol. % iodide; average grain diameter 0.35 μm; spectrally sensitised with sensitising dyes XGS-1, XGS-2 and XGS-3 in ratio of 2.8:1:0.2) prepared from 1.9 g of $AgNO_3$ with
  - 1.8 g of gelatine
  - 0.54 g of magenta coupler XM-1
  - 0.065 g of coloured coupler XMY-1
  - 0.24 g of DIR coupler XDIR-1
  - 0.6 g of TCP Layer 7: (2nd green-sensitive layer, high sensitivity)
- Green-sensitised silver bromide-iodide emulsion (9 mol. % iodide; average grain diameter 0.8 μm; spectrally sensitised with sensitising dyes XGS-1, XGS-2 and XGS-3 in ratio of 2.8:0.9:0.25) prepared from 1.25 g of $AgNO_3$ with
  - 1.1 g of gelatine
  - 0.195 g of magenta coupler XM-2
  - 0.05 g of coloured coupler XMY-2
  - 0.245 g of TCP Layer 8: (Yellow filter layer)
- Yellow colloidal silver sol containing
  - 0.09 g of Ag
  - 0.25 g of gelatine
  - 0.08 g of scavenger XSC-1
  - 0.40 g of formaldehyde scavenger XFF-1
  - 0.08 g of TCP Layer 9: (1st blue-sensitive layer, low sensitivity)
- Blue-sensitised silver bromide-iodide emulsion (6 mol. % iodide; average grain diameter 0.6 μm; spectrally sensitised with sensitising dye XBS-1) prepared from 0.6 g of $AgNO_3$ with
  - 2.2 g of gelatine
  - 1.1 g of yellow coupler XY-1
  - 0.037 g of DIR coupler XDIR-1
  - 1.14 g of TCP Layer 10: (2nd blue-sensitive layer, high sensitivity)
- Blue-sensitised silver bromide-iodide emulsion (10 mol. % iodide; average grain diameter 1.2 μm; spectrally sensitised with sensitising dye XBS-1) prepared from 0.6 g of $AgNO_3$ with
  - 0.6 g of gelatine
  - 0.2 g of yellow coupler XY-1
  - 0.003 g of DIR coupler XDIR-1
  - 0.22 g of TCP Layer 11: (Micrate layer)
- Micrate silver bromide-iodide emulsion (0.5 mol. % iodide; average grain diameter 0.06 μm) prepared from 0.06 g of $AgNO_3$ with
  - 1.0 g of gelatine
  - 0.3 g of UV absorber XUV-2
  - 0.3 g of TCP Layer 12: (Protective & hardening layer)
- 0.25 g of gelatine
- 0.75 g of hardener XH-1,
- such that, once hardened, the total layer structure had a swelling factor of ≦3.5.

Compounds Used in Layer Structure 1A
XUV-1
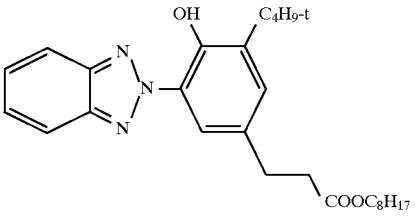
XUV-2
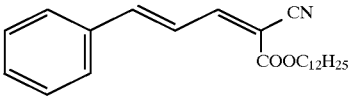
XW-1
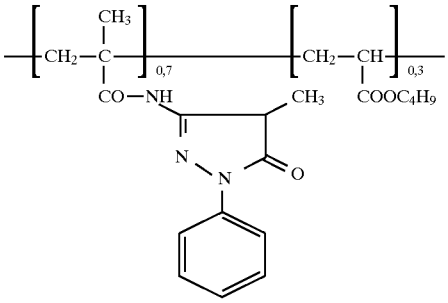
XC-1
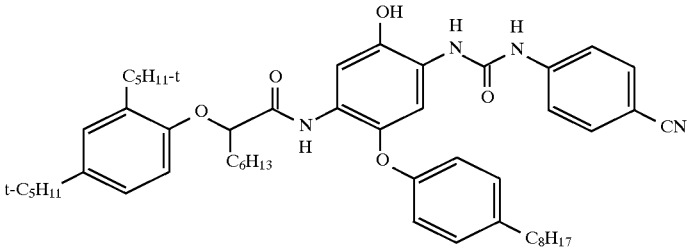
XC-2
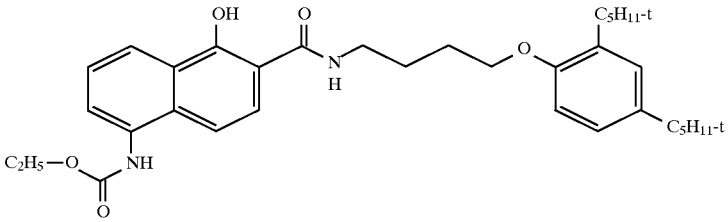
XCR-1
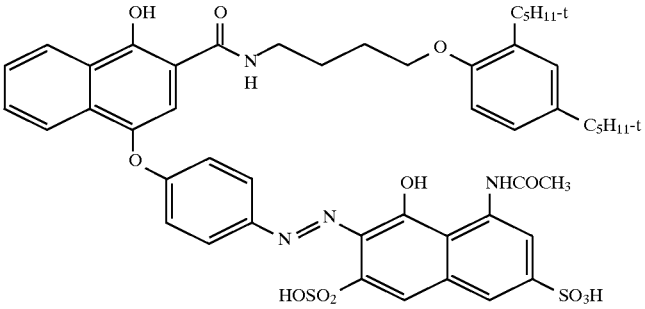

-continued
XCY-1
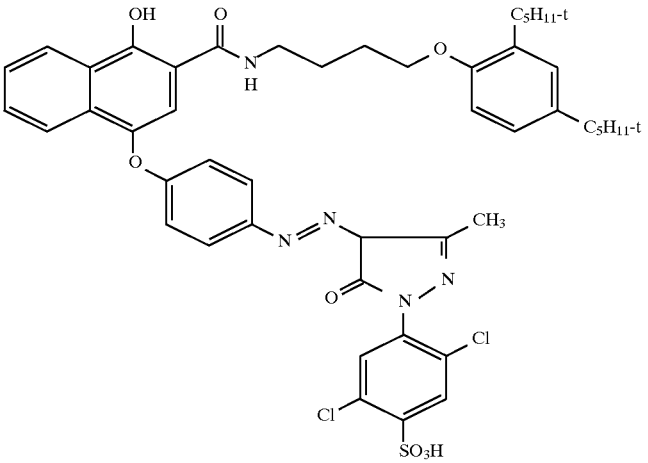
XM-1
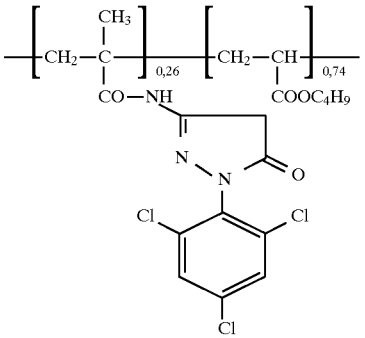
XM-2
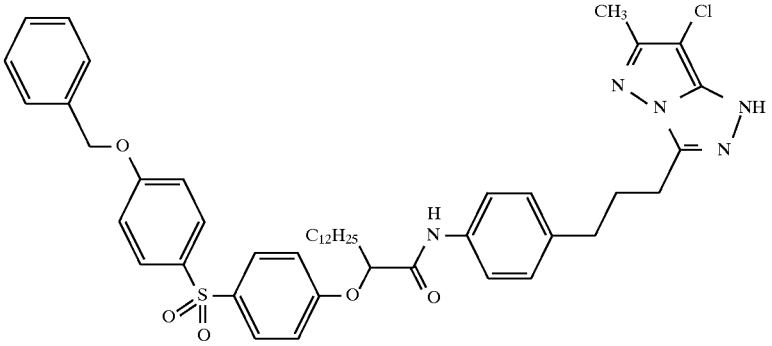
XMY-1
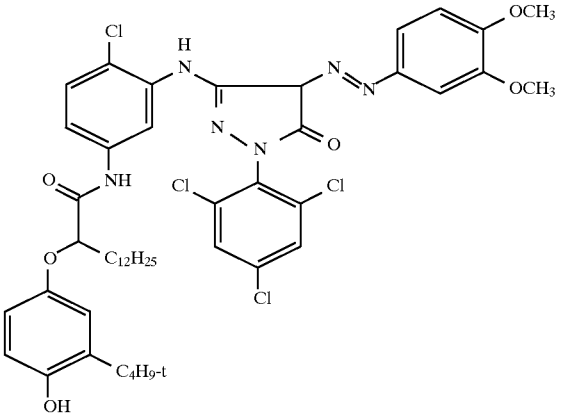

-continued
XMY-2
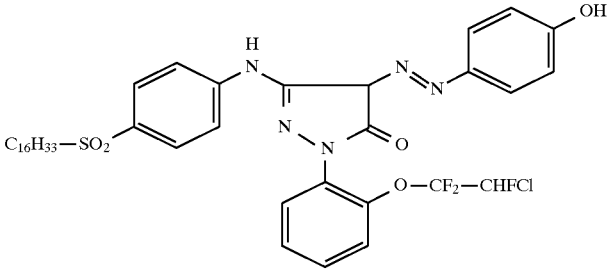
XY-1
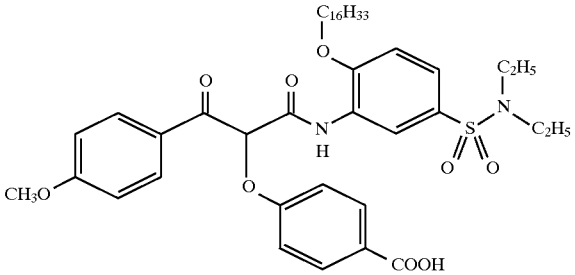
XDIR-1
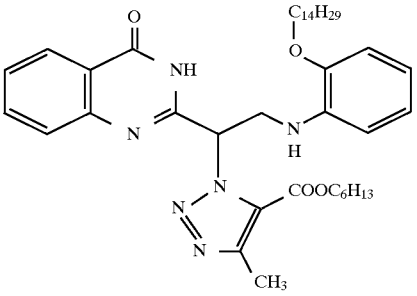
XSC-1
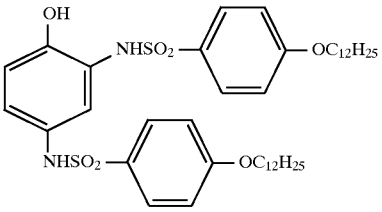
XH-1
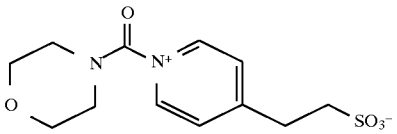
XFF-1
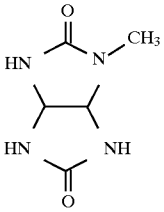

Sensitising Dyes Used in Example 1

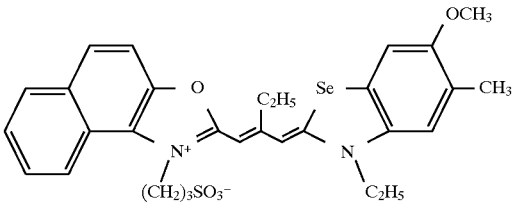

XRS-1

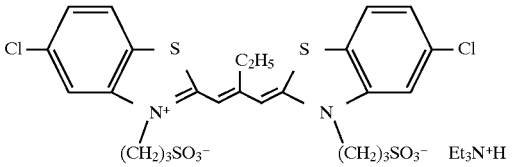

XRS-2

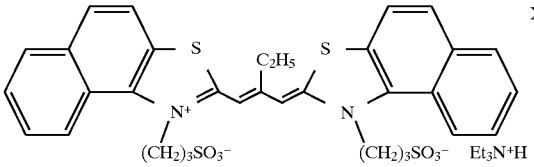

XRS-3

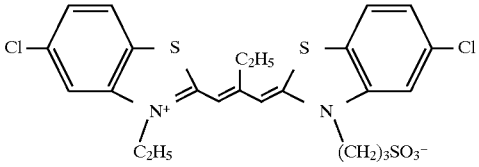

XRS-4

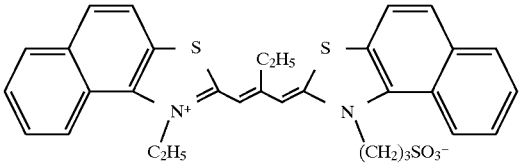

XRS-5

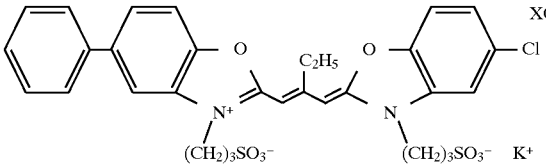

XGS-1

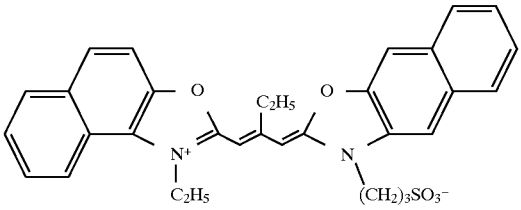

XGS-2

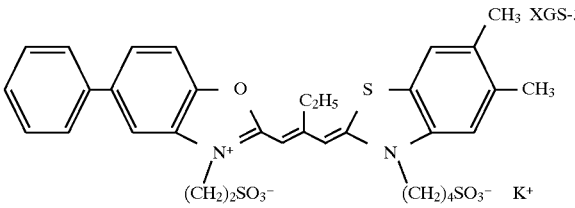

XGS-3

-continued

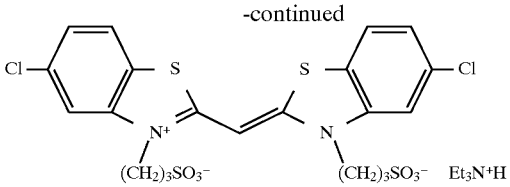

XBS-1

Spectral sensitisation was modified as follows in layer structures 1B, 1C, 1D, 1E and 1F according to the invention:

| Layer | Dyes used | Mixing ratio |
|---|---|---|
| | Layer structure 1B | |
| 3 | F-1, XRS-2, XRS-3 | 1:2:0.3 |
| 4 | F-1, XRS-2, XRS-3 | 1:1.9:0.4 |
| 6 | XGS-1, XGS-2, XGS-3 (= F-1) | 2.8:1:0.2 |
| 7 | XGS-1, XGS-2, XGS-3 (= F-1) | 2.8:0.9:0.25 |
| | Layer structure 1C | |
| 3 | F-1, XRS-4, XRS-5 | 1:2:0.35 |
| 4 | F-1, XRS-4, XRS-5 | 1:2.1:0.3 |
| 6 | XGS-1, XGS-2, XGS-3 (= F-1) | 2.8:1:0.2 |
| 7 | XGS-1, XGS-2, XGS-3 (= F-1) | 2.8:0.9:0.25 |
| | Layer structure 1D | |
| 3 | F-2, XRS-4, XRS-5 | 1:2.1:0.25 |
| 4 | F-2, XRS-4, XRS-5 | 1:2:0.3 |
| 6 | XGS-1, XGS-2, XGS-3 (= F-1) | 2.8:1:0.25 |
| 7 | XGS-1, XGS-2, XGS-3 (= F-1) | 2.8:1.1:0.2 |
| | Layer structure 1E | |
| 3 | F-3, XRS-4, XRS-5 | 1:2:0.35 |
| 4 | F-3, XRS-4, XRS-5 | 1:2.2:0.25 |
| 6 | XGS-1, XGS-2, F-2 | 2.8:1.1:0.3 |
| 7 | XGS-1, XGS-2, F-2 | 2.7:1:0.3 |
| | Layer structure 1F | |
| 3 | F-2, XRS-2, XRS-3 | 1:2:0.3 |
| 4 | F-2, XRS-2, XRS-3 | 1:1.9:0.4 |
| 6 | XGS-1, XGS-2, F-3 | 2.8:1:0.3 |
| 7 | XGS-1, XGS-2, F-3 | 2.7:1.1:0.25 |

Once exposed with a grey wedge, layer structures 1A to 1F were processed using a colour negative process described in *The British Journal of Photography,* 1984, pages 597 and 598.

The sensitivities $E_{magenta}$ and $E_{cyan}$ of layer structures 1B to 1F according to the invention are compared in Table 1 with those of the comparison layer structure 1A. Table 2 shows the results of CIELAB measurements used to characterise the colour tone shifts. Only those colours which are particularly strongly changed are mentioned.

CIELAB measurements have long been used for the colorimetric description of colour negative films. The method is comprehensively described in, for example, R. W. G. Hunt, *The Reproduction of Color,* Fountain Press (1988). In addition to colour saturation, the shift in colour tone relative to standard colour cards is an important feature when characterising colour negative films. A low value in Table 2 means that the deviation from the original is slight and the film may thus be rated particularly favourably.

TABLE 1

| Layer structure | $E_{magenta}$ | $E_{cyan}$ |
|---|---|---|
| 1A | 100 | 100 |
| 1B | 105 | 130 |
| 1C | 105 | 135 |

TABLE 1-continued

| Layer structure | $E_{magenta}$ | $E_{cyan}$ |
|---|---|---|
| 1D | 110 | 125 |
| 1E | 105 | 135 |
| 1F | 115 | 140 |

TABLE 2

| | Colour tone shifts [relative CIELAB units] | | | | |
|---|---|---|---|---|---|
| Layer structure | Blue Flower | Purple | Modern Red | Magenta | Yellow-green |
| 1A | 12 | 14 | 9 | 12 | 9 |
| 1B | 2 | 3 | 6 | 6 | 4 |
| 1C | 3 | 5 | 5 | 4 | 5 |
| 1D | 3 | 2 | 3 | 4 | 5 |
| 1E | 0 | 1 | 2 | 3 | 4 |
| 1F | 2 | 3 | 4 | 5 | 4 |

We claim:

1. A color photographic recording material which comprises a film support and, arranged thereon, at least one red-sensitive silver halide emulsion layer containing a cyan coupler and a red-sensitizing dye, at least one green-sensitive silver halide emulsion layer containing a magenta coupler and a green sensitizing dye, at least one blue-sensitive silver halide emulsion layer containing a yellow coupler and a blue-sensitizing dye and optionally further non-photosensitive layers, wherein at least one of the red-sensitive silver halide emulsion layers thereof and at least one of the green-sensitive silver halide emulsion layers thereof each contain, in addition to green and red sensitizing dyes, at least one additional cyanine dye having an absorption spectrum in a methanolic solution in the range from 515 to 550 nm, wherein the absorption maximum of the additional cyanine dye in the red-sensitive silver halide emulsion layer and the absorption maximum of the additional cyanine dye in the green-sensitive silver halide emulsion layer, in each case measured in a methanolic solution, are no more than 10 nm apart.

2. The recording material according to claim 1, wherein the additional cyanine dye in the red-sensitive silver halide emulsion layer is identical to the additional cyanine dye in the green-sensitive silver halide emulsion layer.

3. The color photographic recording material according to claim 2, wherein said additional cyanine dye is selected from the group consisting of

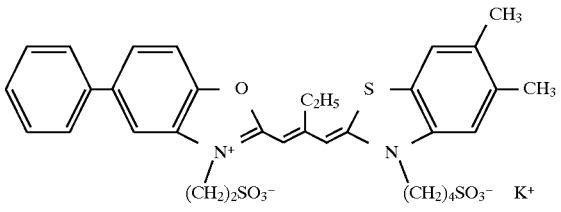

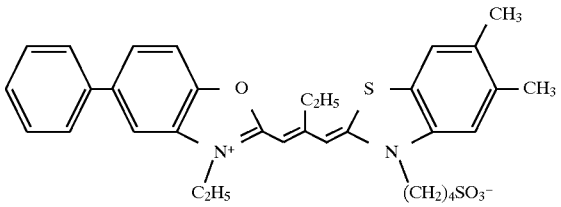

-continued

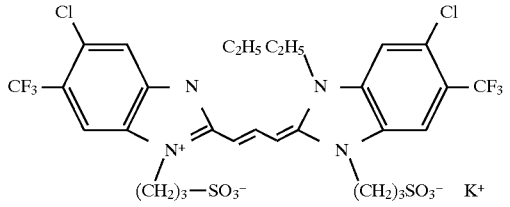

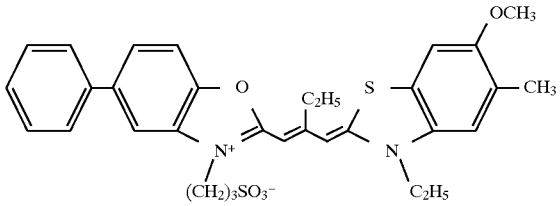

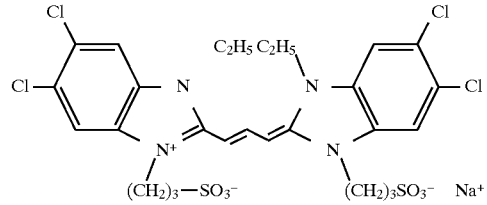

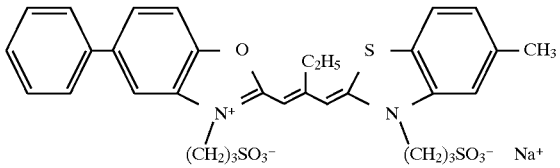

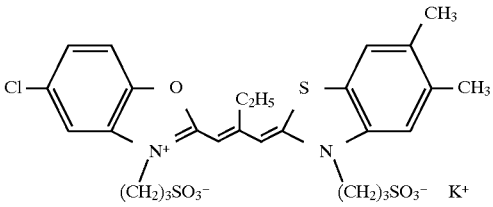

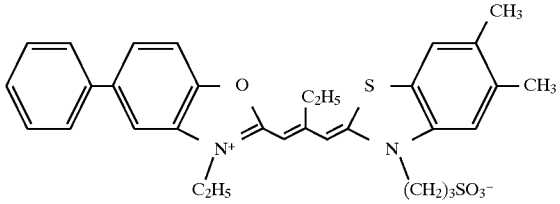

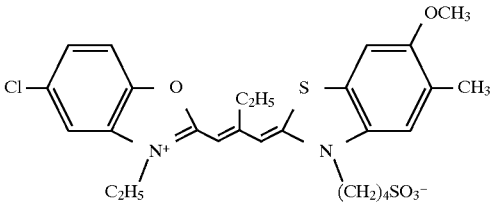

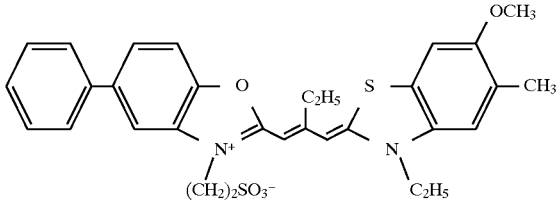

-continued

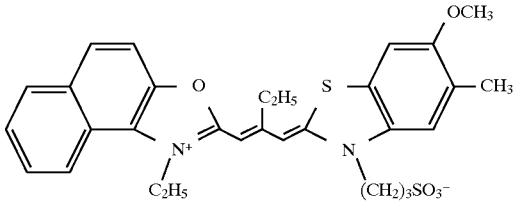

and

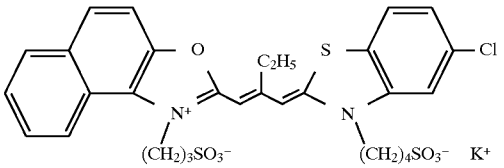

4. The recording material according to claim 1, wherein said absorption spectrum in the methanolic solution is in the range from 517 to 540 nm.

5. The recording material according to claim 1, wherein said additional cyanine dye is a carbocyanine dye which, on at least one of the two ring nitrogen atoms, bear an alkyl residue substituted by an acid group.

6. The recording material according to claim 5, wherein said carbocyanine dye is a benzimidazolecarbocyanine or oxathiacarbocyanine dye.

7. The recording material according to claim 1, wherein the absorption maximum of the additional cyanine dye in the red-sensitive silver halide emulsion layer and the absoption maximum of the additional cyanine dye in the green-sensitive silver halide emulsion layer, in each case measured in a methanolic solution, are no more than 5 nm apart.

* * * * *